US011176917B2

(12) United States Patent
Watanabe

(10) Patent No.: US 11,176,917 B2
(45) Date of Patent: Nov. 16, 2021

(54) AUTOMATIC ARRANGEMENT OF MUSIC PIECE BASED ON CHARACTERISTIC OF ACCOMPANIMENT

(71) Applicant: YAMAHA CORPORATION, Hamamatsu (JP)

(72) Inventor: Daichi Watanabe, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 664 days.

(21) Appl. No.: 16/120,885

(22) Filed: Sep. 4, 2018

(65) Prior Publication Data

US 2018/0374464 A1 Dec. 27, 2018

Related U.S. Application Data

(62) Division of application No. 15/262,594, filed on Sep. 12, 2016, now abandoned.

(30) Foreign Application Priority Data

Sep. 18, 2015 (JP) ..... 2015-185300

(51) Int. Cl.
*G10H 1/28* (2006.01)
*G10H 1/38* (2006.01)

(52) U.S. Cl.
CPC ..... *G10H 1/383* (2013.01); *G10H 2210/105* (2013.01); *G10H 2210/185* (2013.01); *G10H 2210/335* (2013.01); *G10H 2210/576* (2013.01)

(58) Field of Classification Search
CPC ..... G10H 1/383; G10H 1/28; G10H 1/36; G10H 2210/056
(Continued)

(56) References Cited

U.S. PATENT DOCUMENTS 4,232,581 A * 11/1980 Uchiyama ..... G10H 1/383 84/713
4,630,517 A 12/1986 Hall
(Continued)

FOREIGN PATENT DOCUMENTS

JP 2002229561 A 8/2002
JP 2005202204 A 7/2005
(Continued)

OTHER PUBLICATIONS

Office Action issued in U.S. Appl. No. 15/262,594 dated Aug. 21, 2019.
(Continued)

*Primary Examiner* — Christopher Uhlir
(74) *Attorney, Agent, or Firm* — Rossi, Kimms & McDowell LLP

(57) ABSTRACT

Performance information of one or more accompaniment parts is extracted from original performance information. Arranged accompaniment performance information is created using, in accordance with a predetermined arranging condition, only any one or more of pitch names included in the extracted accompaniment performance information. The predetermined arranging condition comprises instructing that any of chord component notes be thinned out in an identified chord progression, and arranged accompaniment performance information is created by thinning out an accompaniment note of a pitch name corresponding to the chord component note having been instructed to be thinned out. Another predetermined arranging condition comprises setting a ratio between chords and arpeggios in one or more measures, and a combination of chords and arpeggios in the extracted accompaniment part performance information is changed so that a ratio between chords and arpeggios in one
(Continued)

or more measures in the extracted accompaniment performance information assumes the set ratio.

20 Claims, 4 Drawing Sheets

(58) Field of Classification Search
USPC ..... 84/613
See application file for complete search history.

(56) References Cited

U.S. PATENT DOCUMENTS

| | | | | |
|---|---|---|---|---|
| 4,864,908 | A * | 9/1989 | Kino | G10H 1/36 84/638 |
| 5,056,401 | A | 10/1991 | Yamaguchi et al. | |
| 5,491,298 | A | 2/1996 | Eiichiro | |
| 5,525,749 | A | 6/1996 | Aoki | |
| 6,294,720 | B1 | 9/2001 | Aoki | |
| 7,432,436 | B2 | 10/2008 | Ito et al. | |
| 7,525,036 | B2 | 4/2009 | Shotwell et al. | |
| 7,584,218 | B2 | 9/2009 | Miyajima et al. | |
| 7,935,877 | B2 | 5/2011 | Lemons | |
| 8,239,052 | B2 | 8/2012 | Itoyama et al. | |
| 8,338,686 | B2 | 12/2012 | Mann et al. | |
| 9,251,773 | B2 | 2/2016 | Buskies et al. | |
| 9,728,173 | B2 | 8/2017 | Watanabe | |
| 2013/0112065 | A1 | 5/2013 | Rutledge et al. | |
| 2013/0305907 | A1 | 11/2013 | Kakishita | |
| 2014/0069263 | A1* | 3/2014 | Chen | G10H 1/0025 84/613 |
| 2015/0013527 | A1 | 1/2015 | Buskies et al. | |
| 2015/0013528 | A1 | 1/2015 | Buskies et al. | |
| 2017/0084259 | A1 | 3/2017 | Watanabe | |

FOREIGN PATENT DOCUMENTS

| | | | |
|---|---|---|---|
| JP | 2008145564 | A | 6/2008 |
| JP | 2012203216 | A | 10/2012 |

OTHER PUBLICATIONS

Notice of Allowance issued in U.S. Appl. No. 15/262,548 dated Apr. 10, 2019.
Office Action issued in U.S. Appl. No. 15/262,548 dated Jan. 22, 2019.
Office Action issued in U.S. Appl. No. 15/262,594 dated Jan. 17, 2020.
Office Action issued in Japanese Appln. No. 2015-185300 dated Jul. 2, 2019. English translation provided.
Office Action issued in U.S. Appl. No. 15/262,594 dated Feb. 26, 2019.
Office Action issued in U.S. Appl. No. 15/262,625 dated Dec. 15, 2016.
Notice of Allowance issued in U.S. Appl. No. 15/262,625 dated Apr. 10, 2017.
Office Action issued in U.S. Appl. No. 15/262,548 dated Jul. 13, 2018.
Office Action issued in U.S. Appl. No. 15/262,594 dated Aug. 16, 2018.

* cited by examiner

ACCOMPA. PART OF ORIGINAL PERFORMANCE INFO.

ARRANGED ACCOMPA. PART PERFORMANCE INFO.

ACCOMPA. PART OF ORIGINAL PERFORMANCE INFO.

ARRANGED ACCOMPA. PART PERFORMANCE INFO.

ACCOMPA. PART INCLUDING CHORDS & ARPEGGIO OF ORIGINAL PERFORMANCE INFO.

ARRANGED ACCOMPA. PART PERFORMANCE INFO. (CHORD 100% & ARPEGGIO 0%)

ARRANGED ACCOMPA. PART PERFORMANCE INFO. (CHORD 75% & ARPEGGIO 25%)

AUTOMATIC ARRANGEMENT OF MUSIC PIECE BASED ON CHARACTERISTIC OF ACCOMPANIMENT

BACKGROUND

The present invention relates generally to techniques for automatically musically arranging music performance information and more particularly to a technique capable of making a simple automatic arrangement (musical arrangement), capable of being performed by a human player with ease, without losing musical quality of an original music piece.

Japanese Patent Application Laid-open Publication No. 2005-202204 (hereinafter referred to as "Patent Literature 1") discloses a technique in which a user selects a desired part (musical part) from MIDI-format automatic performance data of a plurality of parts of a given music piece and a musical score of a desired format is created for the user-selected part. According to a specific example disclosed in Patent Literature 1, the user selects a melody part, accompaniment data suitable for a melody of the selected melody part are automatically created, and then a musical score comprising the selected melody part and an accompaniment part based on the automatically-created accompaniment data is created. More specifically, Patent Literature 1 discloses a method for automatically creating accompaniment data suitable for a melody, in which a plurality of accompaniment patterns corresponding to different performance levels are prepared in advance, one of the accompaniment patterns that corresponds to a performance level selected by the user is selected, and accompaniment data are automatically created on the basis of the selected accompaniment pattern and with a chord progression in the melody taken into consideration.

With the prior technique disclosed in Patent Literature 1, however, it is not possible to make musical arrangements, such as changing tone generation timings of individual accompaniment tones based on the user-selected accompaniment pattern, deleting any of the accompaniment tones, and/or adding one or more new accompaniment tones. Further, with the technique disclosed in Patent Literature 1, the accompaniment patterns prepared in advance for selection by the user have no direct relation with an original music piece of a melody or the like, to which accompaniment tones based on the accompaniment pattern are to be added, and thus, depending on the accompaniment pattern selection by the user, an accompaniment pattern having a poor musical compatibility with an original music piece, such as a melody, may sometimes be undesirably used.

SUMMARY OF THE INVENTION

In view of the foregoing prior art problems, it is an object of the present invention to provide an automatic arrangement apparatus and method which extract performance information of an accompaniment part from an original music piece and automatically arrange the extracted performance information of the accompaniment part.

In order to accomplish the above-mentioned object, the present invention provides an improved automatic arrangement apparatus, which comprises a processor configured to: acquire original performance information; extract, from the acquired original performance information, performance information of one or more accompaniment parts as accompaniment part performance information; and create arranged accompaniment part performance information by using, in accordance with a predetermined arrangement condition, only any one or more of pitch names included in the extracted accompaniment part performance information.

According to the present invention, performance information of one or more accompaniment parts is extracted as accompaniment part performance information, and arranged accompaniment part performance information is created using only any one or more of pitch names included in the extracted accompaniment part performance information. Thus, the present invention can create accompaniment part performance information having a good compatibility with the original music piece (original performance information) and also can automatically make such an arrangement as to shift an accompaniment note included in the accompaniment part performance information or increase or reduce the number of accompaniment notes included in the accompaniment part performance information.

In an embodiment of the present invention, the processor is further configured to identify a chord progression in the acquired original performance information. The predetermined arranging condition comprises instructing that any of chord component notes be thinned out in the identified chord progression, and the processor is configured to create the arranged accompaniment part performance information by thinning out, from among accompaniment notes in the extracted accompaniment part performance information, an accompaniment note of a pitch name corresponding to the chord component note having been instructed to be thinned out by the predetermined arranging condition. Thus, in a case where the original music piece (original performance information) has a complicated chord progression, for example, the present invention can automatically make such an arrangement as to create simple accompaniment part performance information, so that it can readily make an automatic arrangement capable of being performed with ease by a beginner human player.

In an embodiment of the present invention, the predetermined arranging condition comprises setting a ratio between chords and arpeggios in one or more measures. Here, the processor is configured to create the arranged accompaniment part performance information by changing a combination of chords and arpeggios in the extracted accompaniment part performance information so that a ratio between chords and arpeggios in one or more measures in the extracted accompaniment part performance information assumes the set ratio. In this way, the present invention can automatically make such an unprecedented arrangement as to change as desired a ratio between chords and arpeggios in one or more measures.

The automatic arrangement apparatus of the present invention may be constructed of a dedicated apparatus or circuitry configured to perform necessary functions, or by a combination of program modules configured to perform their respective functions and a processor (e.g., a general-purpose processor like a CPU, or a dedicated processor like a DSP) capable of executing the program modules.

The present invention may be constructed and implemented not only as the apparatus invention discussed above but also as a computer-implemented method invention comprising steps of performing various functions. Also, the present invention may be constructed and implemented as a program comprising a group of instructions executable by a processor for performing the method, as well as a non-transitory computer-readable storage medium storing such a program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
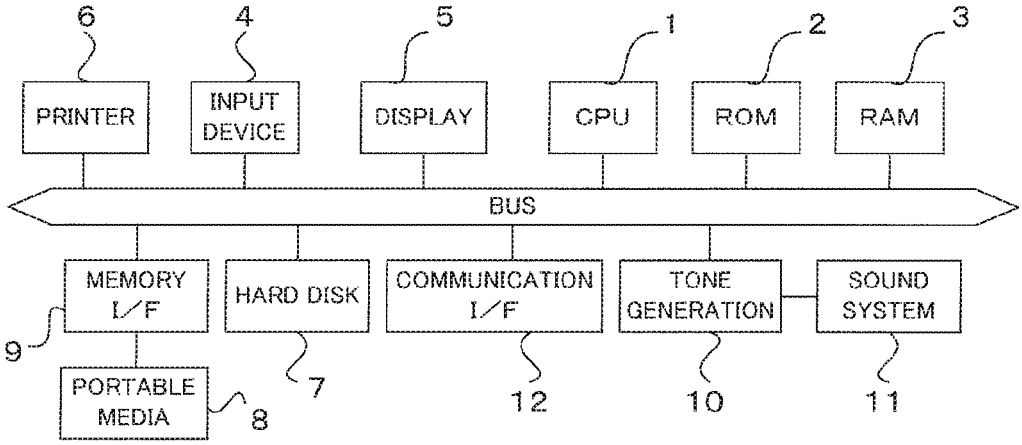
FIG. 1 is a hardware setup block diagram showing an embodiment of an automatic arrangement apparatus of the present invention.

FIG. 1 is a hardware setup block diagram showing an embodiment of an automatic arrangement apparatus of the present invention. The embodiment of the automatic arrangement apparatus need not necessarily be constructed as an apparatus dedicated to automatic arrangement and may be any desired apparatus or equipment which has computer functions, such as a personal computer, portable terminal apparatus or electronic musical instrument, and which has installed therein an automatically-arranging application program of the present invention. The embodiment of the automatic arrangement apparatus has a hardware construction well known in the art of computers, which comprises for example among other things: a CPU (Central Processing Unit) 1; a ROM (Read-Only Memory) 2; a RAM (Random Access Memory) 3; an input device 4 including a keyboard and mouse for inputting characters (letters and symbols), signs, etc.; a display 5; a printer 6; a hard disk 7 that is a non-volatile large-capacity memory; a memory interface (I/F) 9 for portable media 8, such as a USB memory; a tone generator circuit board 10; a sound system 11, such as a speaker; and a communication interface (I/F) 12 for connection to external communication networks. The automatically-arranging application program of the present invention, other application programs and control programs are stored in a non-transitory manner in the ROM 2 and/or the hard disk 7.

Figure 2:
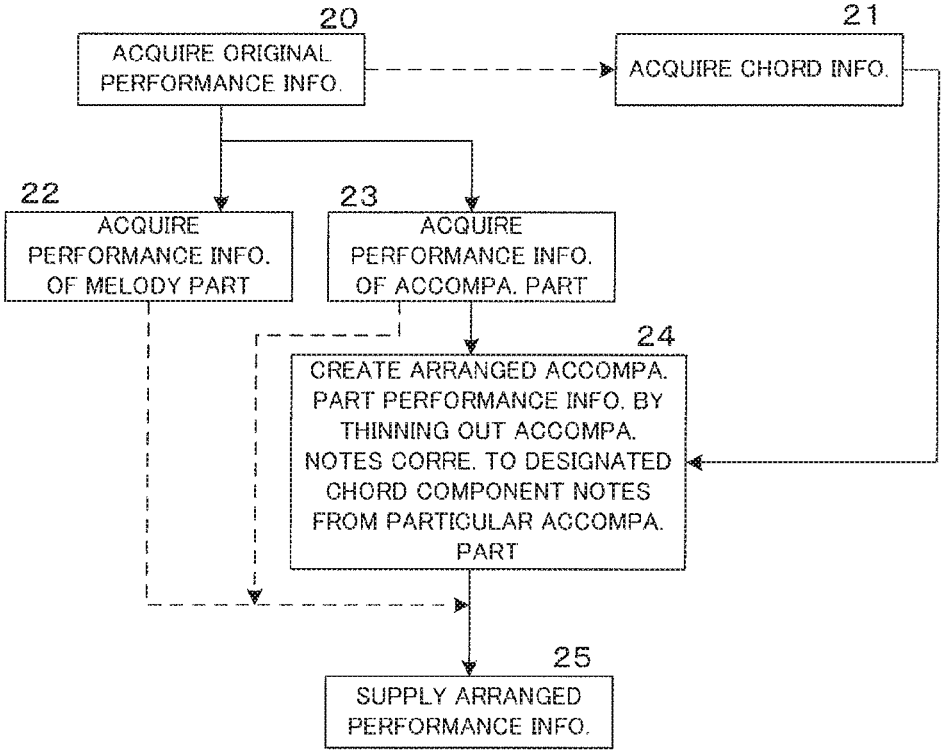
FIG. 2 is a functional block diagram explanatory of processing according to an embodiment of the present invention performed under the control of a CPU.

FIG. 2 is a functional block diagram explanatory of processing according to an embodiment of the present invention performed under the control of the CPU 1. First, music performance information (hereinafter referred to also as "original performance information") that becomes an object of arrangement is acquired in block 20. Any desired specific construction or scheme may be employed for acquiring the original performance information. For example, the original performance information to be acquired may be of any desired data format, such as one comprising data encoded in a predetermined format like a standard MIDI file (commonly known as "SMF"), one comprising image information of a musical score written on a five-line musical staff or one comprising audible audio waveform data, as long as the original performance information can represent a music piece. When original performance information comprising a musical score image has been acquired, for example, the musical score image is analyzed in accordance with a conventionally-known musical score analysis technique, then pitches, beat positions (time positions), note values, etc. of individual notes constituting the original performance information are encoded, but also various marks, such as dynamic and accent marks, are encoded together with their respective time positions. When original performance information comprising audio waveform data has been acquired too, it is only necessary that the audio waveform be analyzed in accordance with a conventionally-known technique for analyzing tone pitches, volumes, etc., then, pitches, beat positions (time positions), note values, etc. of individual notes constituting the original performance information be encoded but also tone volumes be encoded together with their respective time positions. Further, the original performance information to be acquired may comprise any one or desired substantive musical parts, such as: a melody part alone; a right hand part (melody part) and a left hand part (accompaniment or chord part) as in a piano score; a melody part and a chord backing part; or a plurality of accompaniment parts like an arpeggio part and rhythm (drum) part. In the case where the original performance information to be acquired comprises a melody part and an accompaniment part, for example, an arrangement can be made, in accordance with the basic principles of the present invention, to provide accompaniment performance information (e.g., simplified for beginner or novice players or complicated for advanced players) different from original accompaniment performance information of the accompaniment part possessed by the original performance information. Further, a construction or path for acquiring original performance information may be selected as desired. For example, desired original performance information may be acquired via the memory I/F 9 from the portable medium 8 having the desired original performance information stored therein, or may be selectively acquired via the communication I/F 12 from an external source or server. When the CPU 1 performs the process of block 20, it functions as a means for acquiring original performance information.

In block 21, chord information is acquired which is indicative of a chord progression of the music piece in the acquired original performance information. If any chord information is contained in the acquired original performance information, that chord information may be acquired. If no chord information is contained in the acquired original performance information, on the other hand, a chord may be detected by analyzing a melody or accompaniment progression, contained in the acquired original performance information, using a conventionally-known chord analysis technique, and then chord information may be acquired on the basis of the chord detection. Alternatively, a user may input chord information via the input device 4 or the like, and chord information may be acquired on the basis of the user's input. In subsequent generation of harmony-creating accompaniment data, the thus-acquired chord information is used for shifting pitches of accompaniment notes indicated by the accompaniment data.

In blocks 22 and 23, a melody part (if any) and one or more accompaniment parts are separated and extracted from the acquired original performance information, to acquire original performance information of the melody part (block 22) and original performance information of each of the one or more accompaniment parts (accompaniment part performance information) (block 23). Note that, if the original performance information acquired in block 20 contains part information or identification information similar to the part information, part-specific original performance information may be acquired by use of such part information or identification information. Further, in the case where the original performance information comprises a musical score image and if the musical score comprises a melody score (G or treble clef score) and accompaniment score (F or bass cleft score) as in a piano score or if the musical score comprises part-specific musical staff notations, part-specific original performance information can be acquired on the basis of such a score. If the musical score does not comprise part-specific musical staff notations, notes of individual parts, such as a melody part, chord part and bass part, may be extracted presumptively through analysis of the musical score. When the CPU 1 performs the process of block 23, it functions as a means for extracting, from the acquired original performance information, performance information of one or more accompaniment parts as accompaniment part performance information.

In block 24, arranged accompaniment part performance information is created by arranging a particular accompaniment part, extracted in block 23 above, by using, in accordance with a predetermined arranging condition, any one or more of pitch names included in the accompaniment part performance information of the particular accompaniment part. In the illustrated example of FIG. 2, the predetermined arranging condition comprises instructing that any of chord component notes be thinned out in the identified chord progression, and the process of block 24 is constructed to create the arranged accompaniment part performance information by thinning out accompaniment notes of pitch names, corresponding to the designated chord component notes (i.e., chord component notes instructed to be thinned out by the predetermined arranging condition), from accompaniment notes of the accompaniment part performance information of the extracted particular accompaniment part. When the CPU 1 performs the process of block 24, it functions as a means for creating arranged accompaniment part performance information by using, in accordance with the predetermined arranging condition, any one or more of pitch names included in the extracted accompaniment part performance information of the particular accompaniment part.

Figure 3A:
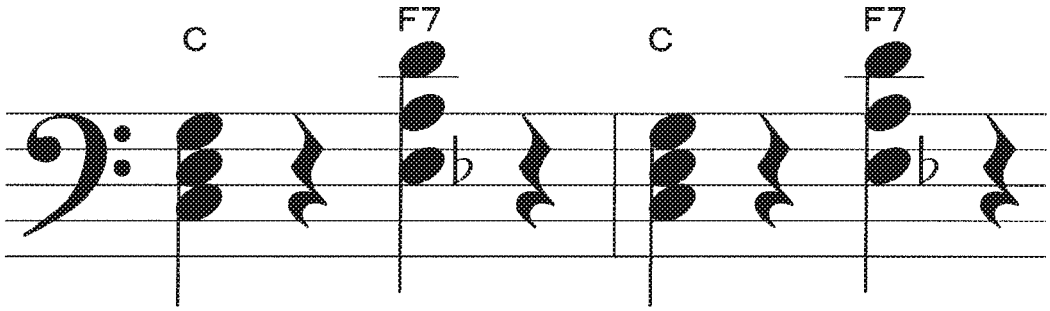
FIGS. 3A and 3B are diagrams showing an example manner in which arranged accompaniment part performance information is created in the embodiment of FIG. 2 by thinning out tension notes of chord component notes.
Figure 3B:
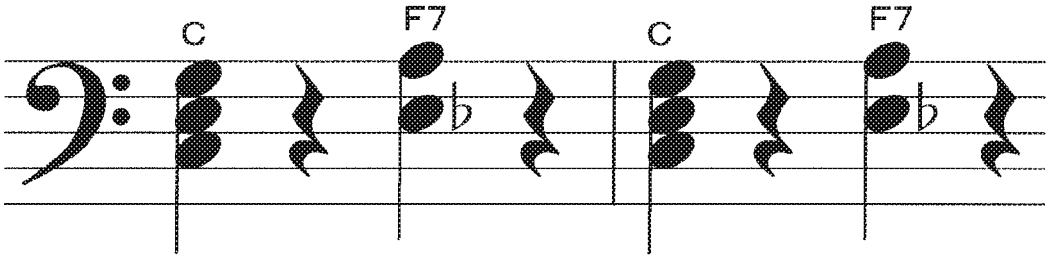

The rule as to how chord component notes to be thinned out should be determined can be defined as appropriate. For example, where the original accompaniment part performance information instructs simultaneously sounding three or more chord component notes, the rule may define that a tension note of the three or more chord component notes be thinned out. FIGS. 3A and 3B show such an example in musical staff notations, of which FIG. 3A shows an example of performance information of a chord part in original performance information and FIG. 3B shows an example of arranged accompaniment part performance information of the chord part created by thinning out the tension note. More specifically, in the illustrated example of FIG. 3A, original accompaniment part performance information representing an F7 chord comprises Eb2 note, A2 note and D3 note. In this case, because the D3 note (13th) is the tension note, this D3 note (13th) is thinned out, so that only Eb2 and A2 notes are generated as arranged accompaniment part performance information corresponding to the F7 chord. Note that, where tension notes are to be thinned out and a plurality of chords to be performed are clichés, it is better to not thin out tension notes because the tension notes in such a case are musically important.

Figure 4A:
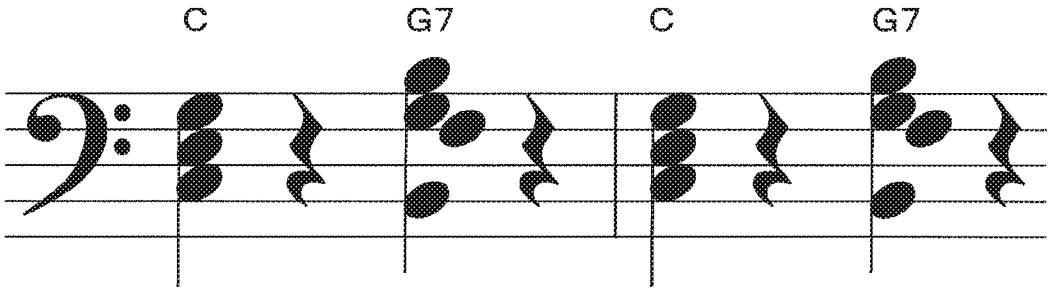
FIGS. 4A and 4B are diagrams showing an example manner in which arranged accompaniment part performance information is created in the embodiment of FIG. 2 by thinning out one of chord component notes of a same pitch name but of different octaves.
Figure 4B:
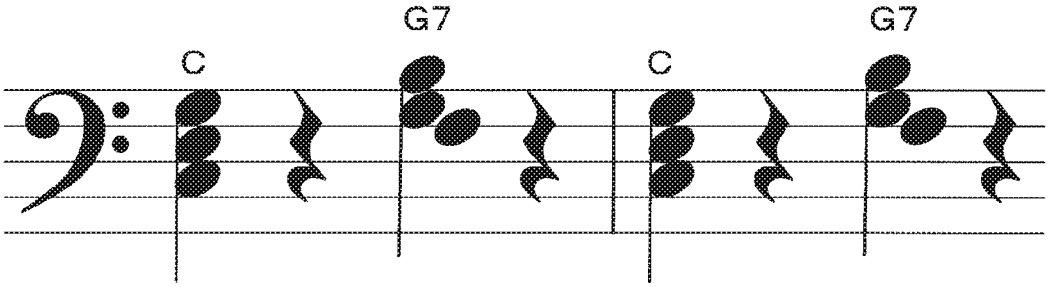

As another example, where the original accompaniment part performance information instructs simultaneously sounding three or more chord component notes, the rule may be defined so as to thin out one of notes of a same pitch name but of different octaves (i.e., notes having a same pitch name but belonging to different octaves) in three or more chord component notes. FIGS. 4A and 4B show such an example in musical staff notations, of which FIG. 4A shows an example of performance information of a chord part in original performance information and FIG. 4B shows an example of arranged accompaniment part performance information of the chord part created by thinning out one of notes of a same pitch name but of different octaves. More specifically, original accompaniment part performance information representing a D7 chord comprises B1 note, F2 note, G2 note and B2 note. In this case, because the B1 and B2 notes are of a same pitch name but difference octaves, one (e.g., lower-pitched one) of the two notes is thinned out, so that F2, G2 and B2 notes are generated as arranged accompaniment part performance information representing the G7 chord. Note that, in this case, a higher-pitched one, rather than the lower-pitched one, of the B1 and B2 notes may be thinned out. An appropriate rule may be preset as to which one of such notes of a same pitch name but difference octaves should be thinned out. If the rule instructs thinning-out of a note such that a pitch shift from immediately-preceding accompaniment part performance information be minimized for a novice player, for example, the high-pitched B2 note will be thinned out in the illustrated example of FIG. 4A.

Note that the rule as to how chord component notes to be thinned out should be determined may be defined, for example, taking into consideration of any one, or a combination of, (1) degrees of dissonance among individual chord component notes in each chord, (2) level of difficulty of performance, (3) degrees of dissonance of individual chord component notes with a melody, etc. Generally, it is considered that, if an arrangement is made involving a low degree of dissonance and low level of difficulty of performance, then the arrangement can be one relatively suitable and natural. Regarding the (1) degrees of dissonance of notes, chord component notes basically have low degrees of dissonance, while a tension note has a high degree of dissonance. Further, the level of dissonance may differ between different chord component notes or between different tension notes. Regarding the (2) level of difficulty of performance, consideration is made, for example, of ease of performing the chord (e.g., a manner of placement of chord component notes) itself, degree of variation in the number of notes (normally, the level of difficulty increases as the variation in the number of notes increases in frequency), degree of necessary fingering movement, etc. Regarding the (3) degrees of dissonance of individual chord component notes with a melody, consideration is made, for example, of conflict of the individual chord component notes with the melody and conflict in sounding pitch range (e.g., octave)

between the individual chord component notes and the melody; note that the degrees of dissonance among the individual chord component notes within each chord is determined in the (1) item above. More specifically, regarding the (3) item, where a chord component note of pitch name "D" and a melody note of pitch name "C" are of a same octave, for example, generated tones would undesirably give a dull feeling because the two notes are too close to each other in pitch; thus, in this case, the chord component note ("D") is thinned out. Regarding the (1) item, on the other hand, a chord component note is thinned out even where the chord component note is of a different sounding pitch range (octave) from a melody note if the chord component note and the melody note are in dissonant relationship; for example, where a chord component note of pitch name "D" and a melody note of pitch name "C" are of different octaves, the chord component note is thinned out because the two notes are in dissonant relationship.

Referring now back to FIG. 2, arranged performance information including the arranged accompaniment data created in block 24 above is supplied to the user in block 25. The arranged performance information may be supplied to the user in any desired fashion or style that may be selected as a matter of design choice. For example, only the arranged accompaniment data created in block 24 may be supplied as electronic data encoded in a predetermined style like the MIDI standard, or visually displayed as a specific musical score image on the display 5, or printed out on a sheet of paper by the printer 6, or supplied as electronic image data. As another example, the original performance information of at least one part of the melody part (if any) and accompaniment part of the original performance information that have been separated and extracted in blocks 22 and 23 above is selected as appropriate (e.g., as desired by the user), the thus-selected original performance information of the at least one part and the arranged accompaniment data created in block 24 are synthesized with each other, and arranged performance information thus synthesized may be supplied as encoded electronic data or as physical or electronic musical score image data.

Figure 5:
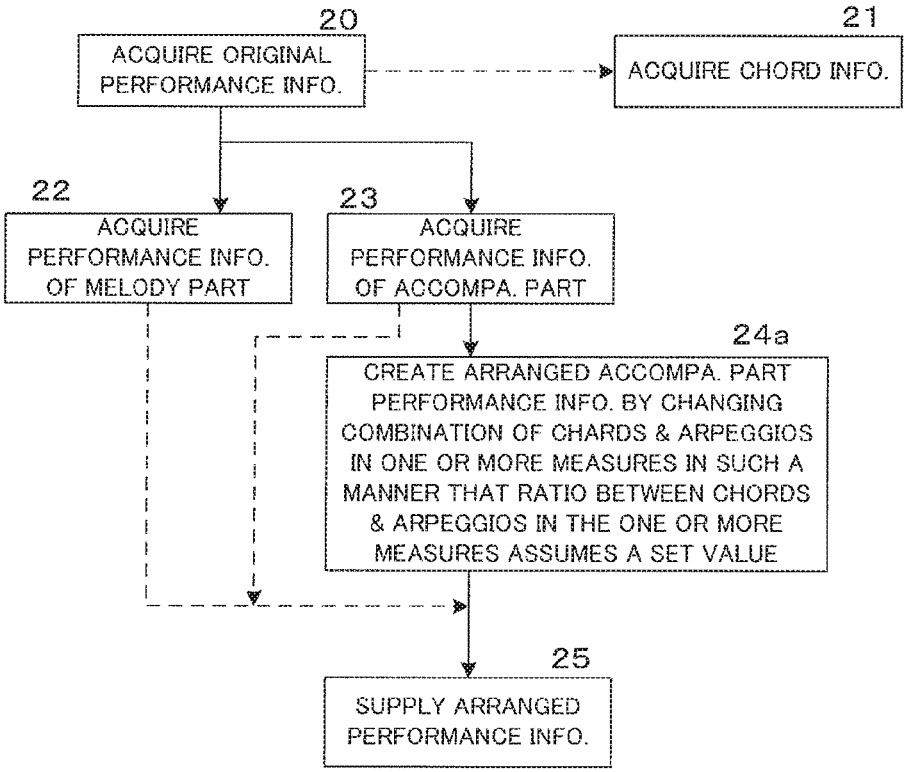
FIG. 5 is a functional block diagram explanatory of processing according to another embodiment of the present invention performed under the control of the CPU.

Further, FIG. 5 is a functional block diagram explanatory of processing according to another embodiment of the present invention performed under the control of the CPU 1. In FIG. 5, the process of block 24*a* is constructed slightly differently from the process of block 24 in FIG. 2, but the processes of other blocks 20, 21, 22, 23 and 25 are constructed similarly to the processes of the same block Nos. in FIG. 2.

The process of block 24*a* is similar to the process of block 24 in that arranged accompaniment part performance information is created by arranging a particular accompaniment part, extracted in block 23 above, by using, in accordance with the predetermined arranging condition, any one or more of pitch names included in accompaniment part performance information of the particular accompaniment part, but different in specific construction from the process of block 24. Namely, an accompaniment including chords and arpeggios is extracted as a single accompaniment part in block 23. Then, in block 24*a*, where the predetermined arranging condition comprises setting a ratio between chords and arpeggios (i.e., chord vs. arpeggio ratio) in one or more measures, the arranged accompaniment part performance information is created by changing a combination of chords and arpeggios in accompaniment part performance information of the extracted accompaniment part, including chords and arpeggios, in such a manner that a ratio between the chords and arpeggios in the accompaniment part performance information in the one or more measures assumes the set ratio. The ratio between chords and arpeggios (chord vs. arpeggio ratio) in the one or more measures may be set at a value desired by the user.

Figure 6A:
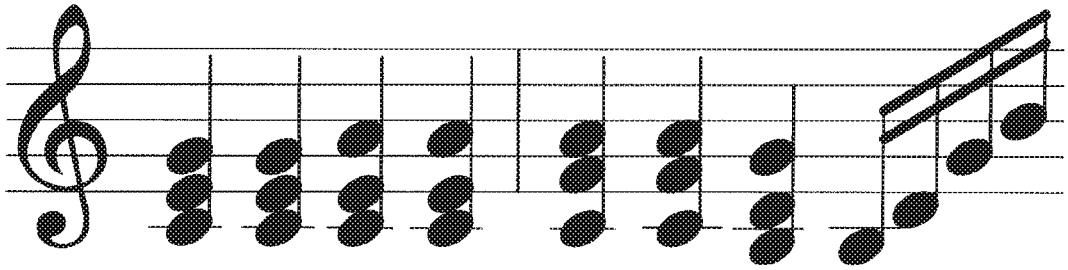
FIGS. 6A to 6C are diagrams showing an example manner in which arranged accompaniment part performance information is created in the embodiment of FIG. 5 by setting at a designated ratio a ratio between chords and arpeggios in a measure.
Figure 6B:
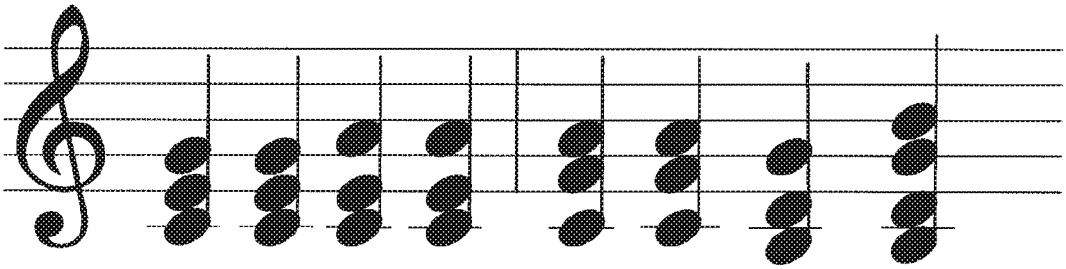
Figure 6C:
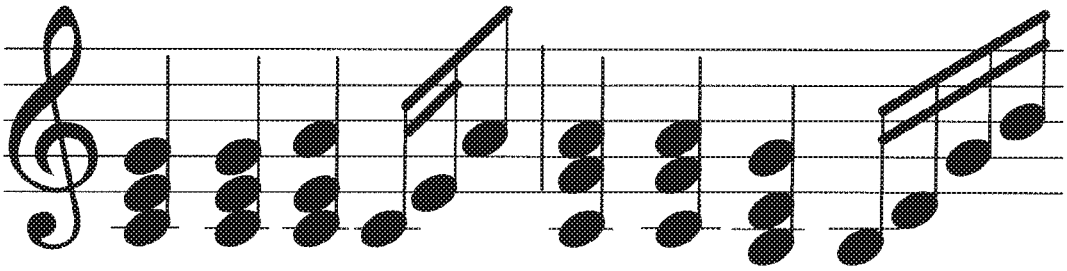

FIGS. 6A to 6C are diagrams showing in musical staff notation an example manner in which arranged accompaniment part performance information is created by the process of block 24*a*. More specifically, FIG. 6A shows an example of performance information of an accompaniment part including chords and arpeggios in original performance information, and FIG. 6B shows an example of arranged accompaniment part performance information, including chords and arpeggios, created in a case where the ratio between chords and arpeggios in a measure is set at 100% (chord) and 0% (arpeggio). In this case, a sixteenth-note arpeggio at the fourth beat of the second measure in the original performance information is changed to a chord of four quarter notes. Further, FIG. 6C shows an example of arranged accompaniment part performance information, including chords and arpeggios, created in a case where the ratio between chords and arpeggios in a measure is set at 75% (chord) and 25% (arpeggio). In this case, a chord of three quarter notes at the fourth beat of the first measure in the original performance information is changed, for example, to an arpeggio of two sixteenth notes and one eighth note. Further, although not particularly shown here, in a case where the ratio between chords and arpeggios in a measure is set at 50% (chord) and 50% (arpeggio), a chord of three quarter notes at each of the second and fourth beats of the first measure in the original performance information may be changed, for example, to an arpeggio of two sixteenth notes and one eighth note, and a chord of three quarter notes at each of the second and fourth beats of the second measure in the original performance information may be changed, for example, to an arpeggio of two sixteenth notes and one eighth note. Furthermore, although not particularly shown here, in a case where the ratio between chords and arpeggios in a measure is set at 0% (chord) and 100% (arpeggio), a chord of three quarter notes at each of the beats of the first measure in the original performance information may be changed, for example, to an arpeggio of two sixteenth notes and one eighth note, and a chord of three quarter notes at each of the first to third beats of the second measure in the original performance information may be changed, for example, to an arpeggio of two sixteenth notes and one eighth note.

Further, as to how a chord should be broken down and converted into an arpeggio, an appropriate rule may be defined such that the chord is converted into an arpeggio in accordance with such a rule. Typically, a note value of each note constituting such a converted-to arpeggio (i.e., arpeggio (component) note) may be determined with the rhythm of the music piece in question taken into consideration. For example, an arpeggio of eighth notes is suitable for an eight-beat music piece, and an arpeggio of sixteenth notes is suitable for a sixteenth-beat music piece. It is generally known that triplet timings have a good compatibility with swing and shuffle music pieces. The rhythm of the music piece in question may be obtained by reference to a setting by the user or genre of the music piece, by detection through analysis of the original performance information, and the like.

Alternatively, various types of arpeggio patterns may be registered in advance for each of various different chord types (such various types of arpeggio patterns to be registered in advance may be set by the user) so that a particular arpeggio pattern corresponding to the type of the chord to be converted into an arpeggio can be selected from among the pre-registered various types of arpeggio patterns and the chord can be converted into an arpeggio in accordance with the selected arpeggio pattern.

Further, in a case where a chord is to be converted into an arpeggio, a manner of determining a series of arpeggio notes (arpeggio component notes) may be differentiated between a time when the percentage of arpeggios (arpeggio percentage) in the above-mentioned chord vs. arpeggio ratio is high and a time when the percentage of arpeggios in the chord vs. arpeggio ratio is low. An arpeggio pattern differing depending on the arpeggio percentage in the chord vs. arpeggio ratio may be used. Namely, if the arpeggio percentage is 80% through 100%, an arpeggio pattern with a series of arpeggio notes covering one measure may be used, or if the arpeggio percentage is 40% through 20%, an arpeggio pattern with a series of arpeggio notes covering one beat may be used. Furthermore, in a case where a plurality of chords are present in a measure, a particular rule may be applied for determining which of the chords in the measure should be converted into an arpeggio. Conceivable examples of such a rule include, among other things, one for preferentially converting chords at the fourth and second beats into arpeggios, one for randomly determining a chord to be converted into an arpeggio, and one for, by reference to a melody (right hand part), preferentially converting into an arpeggio a chord at a position where sounding (tone generation) of a melody note is extended (i.e., the melody note is sustained with a relatively long note value). If an accompaniment is performed in an arpeggio at a position where sounding of a melody note is extended or sustained as noted above, it is conceivable that the user can effectively concentrate on an arpeggio performance with his or her left hand but also can give an appropriate rhythm feel, so that a musical arrangement effective and easy to perform can be achieved.

Furthermore, an appropriate rule may also be defined as to how a series of arpeggio notes should be converted into a chord, so that a series of arpeggio notes can be converted into a chord in accordance with such a rule. Typically, it is assumed here that, in principle, all notes constituting an arpeggio are simultaneously converted into a chord so that they are sounded simultaneously just as in the illustrated example of FIG. 6B. However, a possible musically uncomfortable or unnatural feeling may be minimized by performing any of appropriate operations, with a pitch range and degrees of dissonance of the series of arpeggio notes and length (duration) of the arpeggio taken into consideration, such as reducing any one or some of component notes of the chord, changing octaves of any one or some of the component notes (e.g., inversion of the chord), and dividing the arpeggio into a plurality of chords each having a shorter note length than the length of the arpeggio. For example, in a case where an arpeggio covers (extends across) one measure, it may be divided into any one of different chord patterns, e.g., into two chords each having a half-note length, into four chords each having a quarter-note length, or into a combination of one chord having a half-note length and two chords each having a quarter-note length.

This application is based on, and claims priority to, JP PA 2015-185300 filed on 18 Sep. 2015. The disclosure of the priority application, in its entirety, including the drawings, claims, and the specification thereof, are incorporated herein by reference.

What is claimed is:

1. An automatic arrangement apparatus comprising:

a memory storing instructions; and a processor configured to implement the instructions stored in the memory and execute a plurality of tasks, including:

an acquiring task that acquires original performance information;

an extracting task that extracts, from the acquired original performance information, accompaniment part performance information of at least one accompaniment part;

a setting task that sets a ratio between chords and arpeggios in at least one measure; and a creating task that creates arranged accompaniment part performance information by changing a combination of chords and arpeggios in the extracted accompaniment part performance information to maintain the set ratio between the chords and arpeggios in the at least one measure in the extracted accompaniment part performance information.

2. The automatic arrangement apparatus as claimed in claim 1, wherein the creating task, for changing the combination of chords and arpeggios in the extracted accompaniment part performance information, converts a given chord in the accompaniment part performance information to arpeggio notes.

3. The automatic arrangement apparatus as claimed in claim 2, wherein the creating task converts the given chord in the accompaniment part performance information to the arpeggio notes in accordance with one arpeggio pattern selected from among a plurality of arpeggio patterns.

4. The automatic arrangement apparatus as claimed in claim 2, wherein the creating task determines an arpeggio pattern in accordance with a ratio of the converted arpeggio notes in one measure.

5. The automatic arrangement apparatus as claimed in claim 2, wherein the creating task determines, in accordance with a predetermined rule, which of a plurality of chords present in a measure should be converted to arpeggio notes.

6. The automatic arrangement apparatus as claimed in claim 1, wherein the creating task, for changing the combination of chords and arpeggios in the extracted accompaniment part performance information, converts a series of arpeggio notes in the accompaniment part performance information to one chord using all or some of the series of arpeggio notes.

7. The automatic arrangement apparatus as claimed in claim 1, wherein the creating task, for changing the combination of chords and arpeggios in the extracted accompaniment part performance information, converts a series of arpeggio notes in the accompaniment part performance information to a plurality of chords.

8. The automatic arrangement apparatus as claimed in claim 1, wherein the plurality of tasks include:

an extracting task that extracts performance information of a melody part from the acquired original performance information; and a supplying task that supplies, as arranged performance information, a combination of the extracted performance information of the melody part and the created arranged accompaniment part performance information.

9. The automatic arrangement apparatus as claimed in claim 1, wherein the setting task sets the ratio between the chords and arpeggios in the at least one measure in response to a user's operation.

10. An automatic arrangement method executable by a processor and comprising the steps of:

acquiring original performance information;

extracting, from the acquired original performance information, accompaniment part performance information of at least one accompaniment part;

setting a ratio between chords and arpeggios in at least one measure; and creating arranged accompaniment part performance information by changing a combination of chords and arpeggios in the extracted accompaniment part performance information to maintain the set ratio between the chords and arpeggios in the at least one measure in the extracted accompaniment part performance information.

11. The automatic arrangement method as claimed in claim 10, wherein the creating step, for changing the combination of chords and arpeggios in the extracted accompaniment part performance information, converts a given chord in the accompaniment part performance information to arpeggio notes.

12. The automatic arrangement method as claimed in claim 11, wherein the creating step converts the given chord in the accompaniment part performance information to the arpeggio notes in accordance with one arpeggio pattern selected from among a plurality of arpeggio patterns.

13. The automatic arrangement method as claimed in claim, wherein the creating step determines an arpeggio pattern in accordance with a ratio of the converted arpeggio notes in one measure.

14. The automatic arrangement method as claimed in claim 11, wherein the creating step determines, in accordance with a predetermined rule, which of a plurality of chords present in a measure should be converted to arpeggio notes.

15. The automatic arrangement method as claimed in claim 10, wherein the creating step, for changing the combination of chords and arpeggios in the extracted accompaniment part performance information, converts a series of arpeggio notes in the accompaniment part performance information to one chord using all or some of the series of arpeggio notes.

16. The automatic arrangement method as claimed in claim 10, wherein the creating step, for changing the combination of chords and arpeggios in the extracted accompaniment part performance information, converts a series of arpeggio notes in the accompaniment part performance information to a plurality of chords.

17. The automatic arrangement method as claimed in claim 10, wherein the setting step sets the ratio between the chords and arpeggios in the at least one measure in response to a user's operation.

18. A non-transitory machine-readable storage medium containing a program executable by a processor to perform an automatic arrangement method comprising the steps of:

acquiring original performance information;

extracting, from the acquired original performance information, accompaniment part performance information of at least one accompaniment part;

setting a ratio between chords and arpeggios in at least one measure; and creating arranged accompaniment part performance information by changing a combination of chords and arpeggios in the extracted accompaniment part performance information to maintain the set ratio between the chords and arpeggios in the at least one measure in the extracted accompaniment part performance information.

19. The automatic arrangement apparatus as claimed in claim 2, wherein the creating task converts the given chord in the accompaniment part performance information to the arpeggio notes having note values determined in accordance with a rhythm.

20. The automatic arrangement method as claimed in claim 11, wherein the creating step converts the given chord in the accompaniment part performance information to the arpeggio notes having note values determined in accordance with a rhythm.

* * * * *